United States Patent [19]

Wunderlich

[11] Patent Number: 4,735,039

[45] Date of Patent: Apr. 5, 1988

[54] RING RAIL SUSPENSION ASSEMBLY

[75] Inventor: Guenther C. Wunderlich, Easley, S.C.

[73] Assignee: Platt Saco Lowell Corporation, Easley, S.C.

[21] Appl. No.: 82,163

[22] Filed: Aug. 6, 1987

[51] Int. Cl.[4] ..... D01H 7/10; D01H 1/16

[52] U.S. Cl. ..... 57/137; 57/1 R; 57/136

[58] Field of Search ..... 57/95, 98, 99, 136, 57/137, 1 R, 75

[56] References Cited

U.S. PATENT DOCUMENTS

| | | | |
|---|---|---|---|
| 990,501 | 4/1911 | Rhoades | 57/137 |
| 2,758,439 | 8/1956 | Bradshaw | 57/1 R X |
| 2,770,093 | 11/1956 | Gwaltney | 57/99 |
| 3,022,625 | 2/1962 | Meadows | 57/137 |
| 3,103,095 | 9/1963 | Keyser | 57/1 R |
| 3,183,026 | 5/1965 | Williamson | 57/137 X |
| 3,844,102 | 10/1974 | Brooks | 57/75 X |
| 3,946,545 | 3/1976 | Pray | 57/136 X |
| 3,974,633 | 8/1976 | Clevenger | 57/1 R |

*Primary Examiner*—John Petrakes

*Attorney, Agent, or Firm*—Cort Flint

[57] ABSTRACT

A suspension assembly (A) for raising and lowering the ring rails (14, 14') of a textile yarn processing machine is disclosed. Vertical guide posts (18, 18') are disposed adjacent to each of the ring rails for guiding the ring rails as they reciprocate vertically. The opposed ring rails are connected by the suspension assembly which includes a parallelogram linkage comprised of a tension rod (24) pivotally connected to opposing bearing brackets (B, C) and a compression rod (26) which is pivotally connected to the opposing bearing brackets. Slide bearings (20, 20' and 22, 22') are carried by the bearing brackets (B, C) for bearing against the guide posts (18, 18'). The lengths of the compression rod and the tension rod are adjusted to bring the spaced slide bearings into light contact with an associated guide post so that the ring rails may be lifted by a lifter mechanism in unison without causing loads on the guide posts. If loads (D, E) on the ring rails are generally equal, the parallelogram suspension assembly will cancel any loads on the guide posts. Only the difference between the loads will be exerted on the guide posts.

18 Claims, 3 Drawing Sheets

RING RAIL SUSPENSION ASSEMBLY

BACKGROUND OF THE INVENTION

This invention relates to an improved ring rail lifter mechanism which raises and lowers the ring rails on the sides of a textile yarn twister and similar machines.

There is a need for accurately raising and lowering the ring rails on textile machines such as spinning frames and twisters in a manner that forces are balanced and uneven wear is reduced on the guide posts which guide the ring rails up and down and height adjustments on one side do not effect those of the other side. One example of guides is found in U.S. Pat. No. 3,844,102. In this patent, the ring rail is supported by a bracket which is provided with opposed concave bearings which fit on either side of a guide post. A lifter tape connects the bracket to a lifter mechanism which raises and lowers the ring rail as it is guided vertically by opposing posts. The downward force of the ring rail forces the concave bearings into contact with opposite sides of the guide post. However, in this mechanism the concave bearing rolls are always in high load-bearing contact with the guide posts. Uneven wear often results interferring with accurate up and down travel. U.S. Pat. No. 3,022,625 shows a ring rail suspension having similar load bearing characteristics.

U.S. Pat. No. 2,770,093 discloses a high lift suspension system for ring rails on a spinning frame for large yarn packages. Independent upper and lower slides for raising and lowering the ring rails are joined together by adjustable tie rods. The tie rods may be adjusted to conform to the spacing between the samsons. This is said to eliminate the need for accurately spacing opposing samsons in order to achieve free movement of the slides along the samsons. The tie rods are spring loaded to urge the slides in contact with the samsons. This is to keep yarn guide rings on the rail concentric with the yarn package formed. U.S. Pat. No. 3,974,633 relates to a textile yarn twister having vertical slides joined by bars whose length is not adjustable.

The prior art has somewhat approached the problem of inaccurately spaced vertical guide posts and the forces of the slides on the guide posts. The uneven wear of the guide posts or samsons and the accompanying interference with reciprocating vertical motions while providing means to set the reversal points independently for each side has not been satisfactorily addressed.

Accordingly, an object of the invention to provide a suspension assembly for raising and lowering the ring rails of a textile yarn processing machine in unison with reduced guide post loading and wear and which is easy to adjust.

Another object of the invention is to provide a suspension assembly for raising and lowering the ring rails on a textile twister and the like which balances forces between the slide bearings and the guide posts generally eliminating loads and wear on the guide posts.

Still another object of the invention is to provide a parallelogram linkage assembly having adjustable connector rods to connect the front and rear ring rails of a textile yarn twister so that height adjustment of the rails on one side do not effect the other side and where the ring rails may be raised and lowered in unison without undue stress on the guides.

These and other desirable objects of the invention will be apparent from and/or inherent in the descriptions and explanations which follow.

SUMMARY OF THE INVENTION

A suspension assembly is disclosed for raising and lowering the front and rear ring rails on a textile yarn processing machine. Both of the ring rails are disposed between a set of guide posts which are disposed in vertical planes. The suspension assembly includes front and rear bearing brackets connected to the ring rails. Spaced bearings are carried by the bearing brackets in light contact with the guide posts. The suspension assembly includes a parallelogram linkage assembly having adjustable tension and compression rods pivotally connected to the front and rear bearing brackets. One end of the tension bar is pivotally connected to a bearing bracket at the front ring rail while the other end of the rod is pivotally connected to the bearing bracket at the rear ring rail. One end of the compression rod is pivotally connected to a lower portion of the bearing bracket at the front ring rail. The other end is connected to the bearing bracket at the rear ring rail. The tension rod and the compression rod are connected to the front bearing bracket at the front ring rail by a slip joint. This allows the rods to shift slightly in a horizontal direction in the event the ring rails should strike a foreign object. The tension and compression rods are adjusted in length to urge the bearings into light contact against the guide post disposed adjacent its ring rail. The weight load exerted by the rings on the front ring rails tend to cause the ring rail to pivot about its pivotal connection with the tension rod and to urge the lower spaced bearing away from the guide posts. On the other hand, the weight load of the rings on the rear ring rail tend to cause the rear ring rail to pivot about its pivotal connection with the tension rod. This counterbalances the load exerted by the rings on the front ring rail. The length of the tension rod and the compression rod may be adjusted to assure that each of the spaced bearings are only in light contact with their guide posts at all times. Generally, the loads are equal and there is little, if any, load on the guide posts. If the loads are not equal, only the difference in the loads will be exerted on the guide posts.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF THE DRAWINGS

Figure 1:
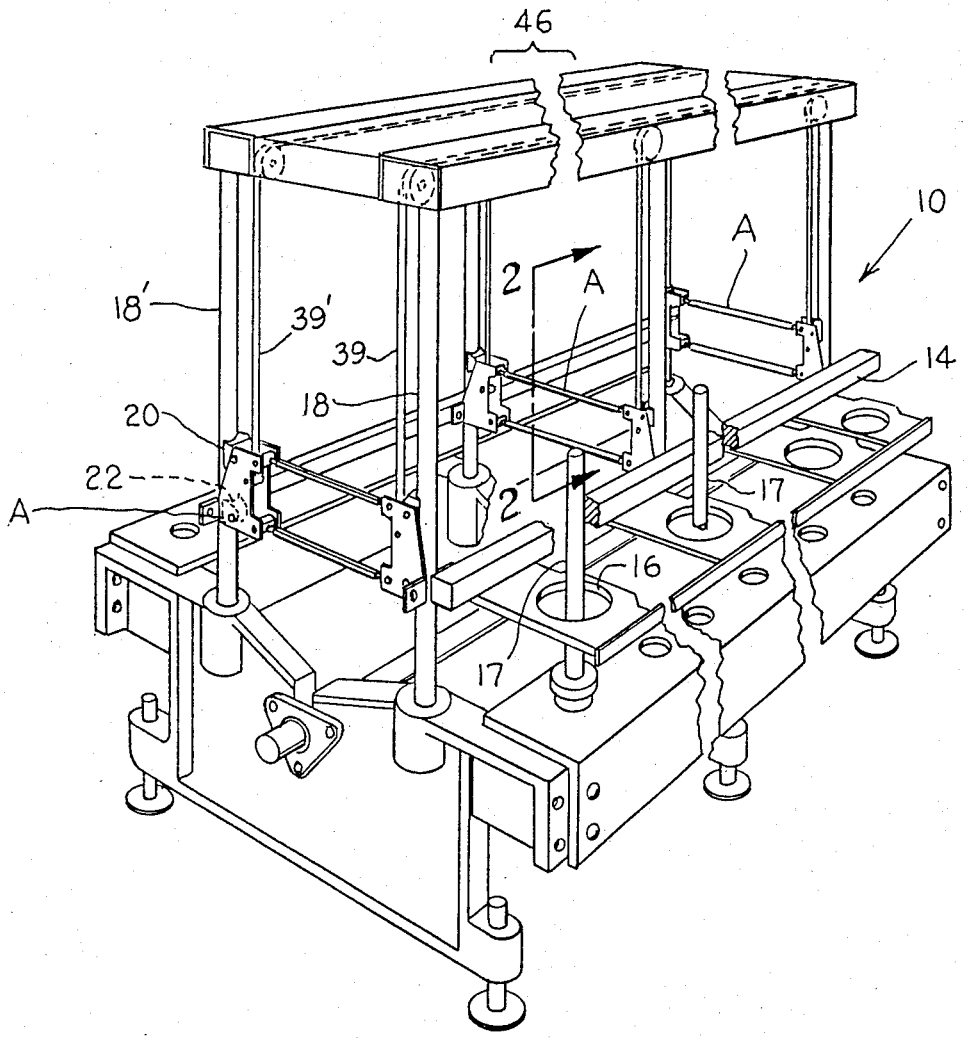
FIG. 1 is a front perspective view of a textile yarn twister machine incorporating ring rail suspension assemblies in accordance with the invention.
Figure 2:
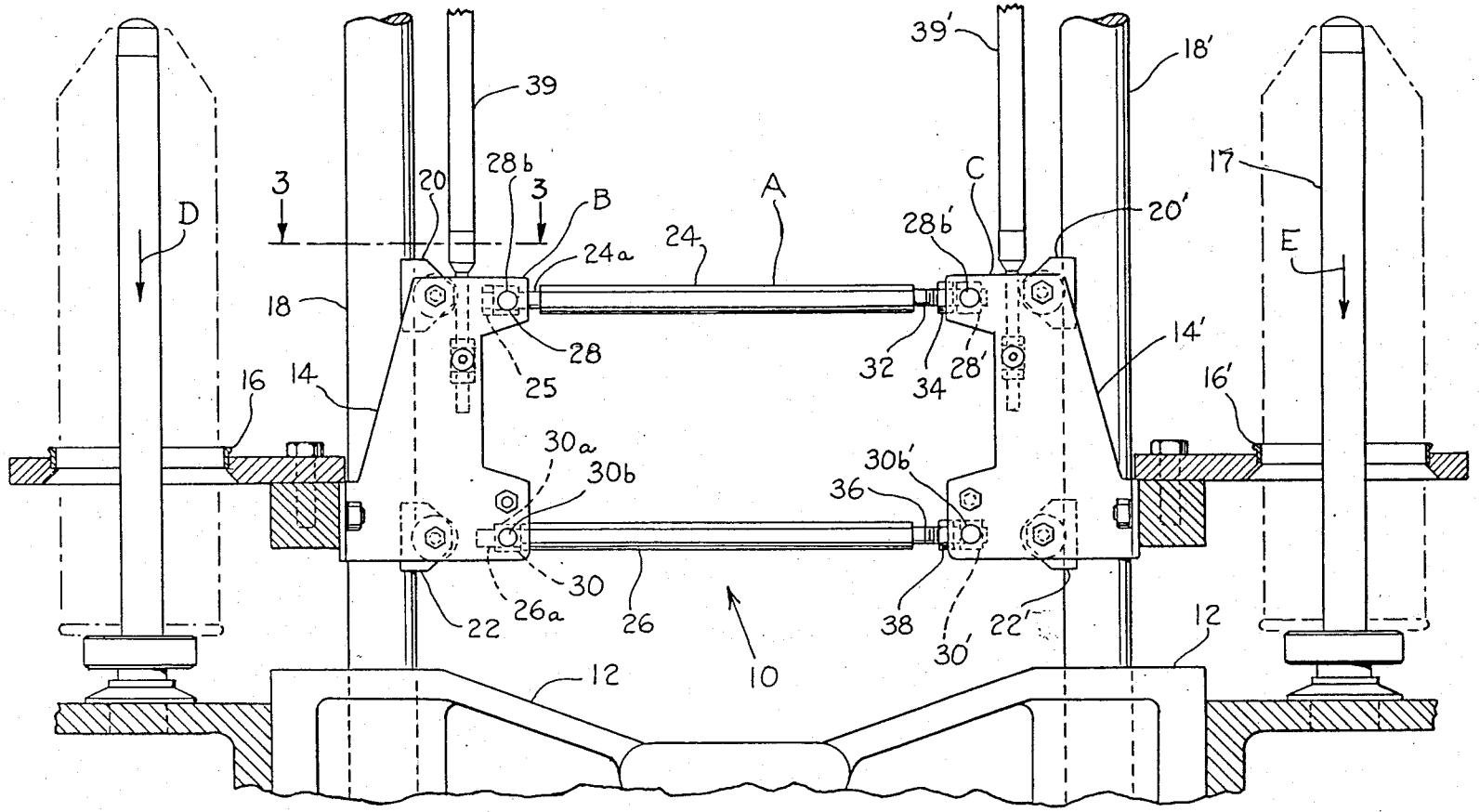
FIG. 2 is a side elevation, partly in section, taken along line 2—2 of FIG. 1.
Figure 3:
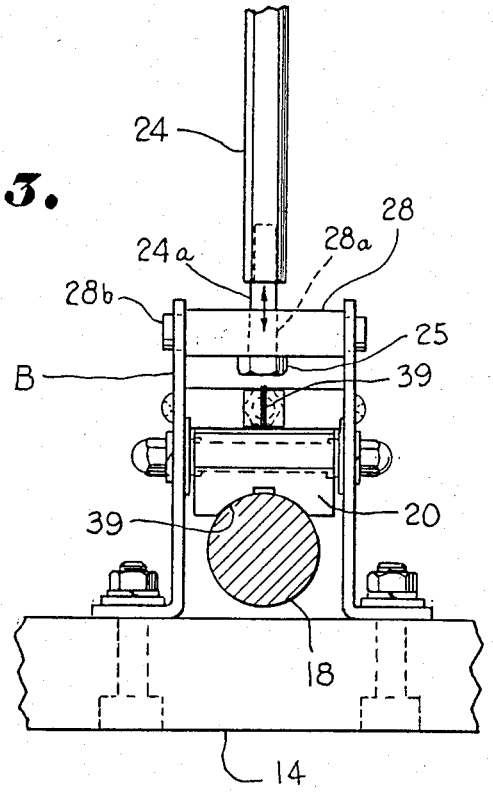
FIG. 3 is a plan view, partly in section taken along line 3—3 of FIG. 2, showing the upper bearing in contact with the guide post.

Referring now to FIGS. 1, 2, and 3 wherein a textile yarn processing machine such as a twister, generally designated as 10, is shown with its elongated frame 12 and front ring rail 14 and rear ring rail 14'. As can best be seen in FIG. 2, ring rails 14 and 14' each carry a plurality of rings 16 and 16', respectively, which extend around a plurality of spindles 17, extending in a row along the front and rear of the twister. A plurality of opposing guide posts 18 and 18' are disposed along the front and the rear of the twister 10 adjacent to the ring rails 14 and 14' respectively. Each ring rail is carried by a plurality of spaced suspension assemblies A that raise and lower the ring rail. Suspension assembly A consists of a parallelogram linkage assembly which provides a means for shifting and balancing forces so that little, if any, loads are exerted on guide posts 18, 18'. Suspension assembly A is carried between opposing guide posts 18, 18'. There are sets of upper and lower slide bearings 20, 22, and 20', 22' adjacent to each of the guide posts 18 and 18'. Front bearings 20, 22 are carried by a front bearing bracket B and rear bearings 20', 22' are carried by a rear bearing bracket C. The bearings are disposed between the ring rails and their associated guide posts.

Figure 4:
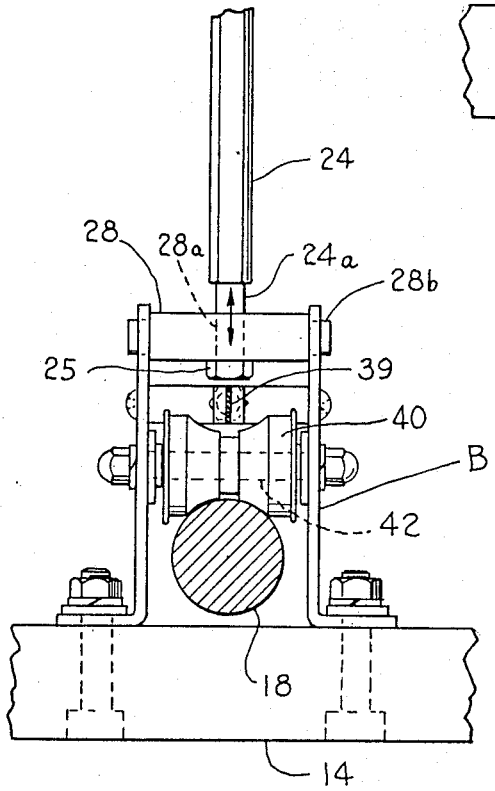
FIG. 4 is a view similar to FIG. 3, but illustrating a different bearing useful with the invention.

As can best be seen in FIG. 2, the spaced bearings 20 and 22 are pivotally connected to bracket B for bearing against the upper and lower portions of guide post 18. Bearings 20' and 22' are pivotally connected to bracket C for bearing against upper and lower portions of guide post 18'. Roller bearings may also be used as shown in FIG. 4. The term bearing meaning any suitable bearing element or surface.

Bearing brackets B and C are interconnected adjacent their upper portions by means of a tension rod 24. Tension rod 24 is pivotally carried by bearing bracket B through a reduced end portion **24*a* which fits within a bore 28*a* of pivotal block 28 pivotally connected by a shaft 28*b* to bracket B. Reduced end 24*a* is permitted to slide in and out of bore 28*a*, but is restricted in movement by a shoulder 24*b* on one end and a nut 25 fixed to the opposing end. In this manner, a pivotal slip joint is provided for tension rod 24 at bracket B. The other end of tension rod 24 comprises a reduced portion 32 which is threaded into a pivotal block 28' having a pivot shaft 28*b'* at bearing bracket C. For adjusting the length of tension rod 24, turn tension rod 24. A locking nut 34 is provided for locking tension rod 24. It will be noted that pivots 28*b* and 28*b'* are disposed adjacent to upper bearings 20 and 20'** respectively.

The lower portions of bearing brackets B and C are interconnected by means of a compression rod 26. One end of compression rod 26 is pivotally connected to the bearing bracket B by a pivotal block 30 having a bore **30*a* through which a loose reduced end 26*a* of rod 26 slides. This provides a pivotal slip joint. Transverse block 30 pivots about a shaft 30*b* carried between legs of bracket B. The opposite end of compression rod 26 has a threaded end 36 threaded into pivotal block 30'. A lock nut 38 locks compression rod 26. The length of compression rod 26 is adjustable to bring bearings 22 and 22' into light contact with guide posts 18 and 18', respectively. Each of bearings 20, 20', 22, and 22' comprise a concave bearing surface 39 which extends about a portion of guide post 18, as best seen in FIG. 3**. While the pivotal slip joints are shown at bearing bracket B, it is also possible that the slip joints are provided in opposing brackets rather than the same.

A conventional lifter mechanism 46 is illustrated schematically in FIG. 1 for completeness. Each suspension assembly A and ring rail 14, 14' is connected to lifting mechanism 46 by means of lifter tapes 39 and 39'. The lifter mechanism, per se, is not a part of the present invention and can take any form so long as it moves lifter tapes 39 and 39' in unison.

In operation, the length of tension rod 24 and compression rod 26 are adjusted to ensure light contact between the surfaces of bearings 20 and 22 with guide post 18 and 20' and 22' with guide post 18'. This permits easy vertical movement of suspension assembly A and the ring rails by lifter tapes 39 and 39'. Applying load D to suspension assembly A causes a reaction in the pivotal parallelogram linkage. Slide bearings 20 and 22' will be forced against guide posts 18, 18'. Applying load E simultaneously causes an identical reaction in the opposite direction, tending to force bearings 22 and 20' against guide posts 18, 18'. When loads D and E are generally equal, bearings 20 and 20' are linked pivotally, and bearings 22 and 22' are linked pivotally, the bearing loads are essentially cancelled. If the loads are unequal, only the difference between load D and load E are exerted by the bearings against the guide posts. Upper rod 24 is in tension and lower rod 26 is in compression. Rod length adjustment is on one side only to get the full benefit of the turns per inch thread for fine adjustment. This also allows use of a slip joint in tension rod 24 for additional freedom of movement should either ring rail unexpectedly hit a foreign object left on the twister during movement. Since the loads on the front and back ring rails are equal or nearly equal, suspension assembly A cancels most of the load on the guide posts reducing wear of the guide posts. Only the difference between the loads on the front and back ring rails will be placed on the guide posts, which should be minimal. Uneven wear of guide posts and accompanying hindrance of vertical ring rail movement are virtually eliminated.

It will be noted from the above description that the rod length adjustment for both the tension rod and the compression rod is only on one side and is only for fine adjustments. Since the load on the bearings will be very light, very little adjustment will be required during the operation of the machine, however, such adjustment as might be required is easily and quickly made.

Referring now to FIG. 4, wherein slide bearing blocks 20 are replaced with a concave rollers 40 having a concavity which is adapted to extend around a portion of the periphery of guide post 18. All or some of bearings 20, 2040 , 22, and 22' may be replaced by concave rollers 40. Concave rollers 40 are mounted for rotation about an axle 42 on spaced arms 44 which in turn are pivotally mounted on ring rails 14 and 14' as the case may be.

Small amounts of adjustment of the elevation of rings 16 or 16' by changing the connected length of the lifter-tapes 39 or 39' do not effect the elevation of rings 16' or 16 because of the pivotal parallelogram linkage of the suspension assembly A.

While a preferred embodiment of the invention has been described using specific terms, such description is for illustrative purposes only, and it is to be understood that changes and variations may be made without departing from the spirit or scope of the following claims.

What is claimed is:

1. In a textile yarn processing machine having an elongated frame with a row of spindles extending along opposed sides of said frame, front and rear vertically reciprocating ring rails extending along said rows of spindles, each said ring rail carrying a plurality of rings associated with said spindles, vertical guide posts disposed adjacent said ring rails for guiding said ring rails reciprocating vertical movements, and a ring rail lifter mechanism adapted to raise and lower said ring rails in unison, a suspension assembly for raising and lowering said ring rails, comprising:

(a) front and rear bearing brackets adapted for attachment to respective front and rear ring rails;

(b) bearings carried by said bearing brackets for contacting said guide posts;

(c) a tension rod pivotally connected between upper portions of said front and rear bearing brackets acting in tension between said bearing brackets when loaded;

(d) a compression rod pivotally connected between lower portions of said front and rear bearing brackets acting in compression between said bearing brackets when loaded; and (e) said tension and compression rods being generally parallel and pivotally connected to said bearing brackets in a manner that loads on said front and rear ring rails produce counterbalanced forces between said bearings and said guide posts reducing wear on said guide posts.

2. The apparatus of claim 1 comprising:

(a) a first pivotal slip joint carried by one of said bearing brackets for pivotally connecting one end of said tension rod to said bearing bracket in a manner that said tension rod may move in pivotal and translational motion; and (b) a second slip joint carried by one of said brackets for pivotally connecting one end of said compression rod to said bearing bracket in a manner that said compression rod may move in pivotal and translational motion.

3. The apparatus of claim 2 including means for adjusting the length of said tension and compression rods in said suspension assembly.

4. The apparatus of claim 1 including means for adjusting the length of said tension rod in said suspension assembly.

5. The apparatus of claim 1 including means for adjusting the length of said compression rod in said suspension assembly.

6. The apparatus of claim 1, where said bearings are pivotally mounted on said bearing brackets.

7. The apparatus of claim 1, wherein said bearings include a plurality of vertically spaced slide blocks carried by said bearing brackets on the same side of said guide posts having a concave surface contacting said guide posts.

8. A textile yarn processing machine comprising:

(a) an elongated frame having a row of spindles extending along opposing sides of said frame;

(b) vertically reciprocating ring rails extending along said rows of spindles on said opposing sides of said frame;

(c) vertical guide posts disposed adjacent said ring rails for guiding said ring rails as they are raised and lowered in vertical reciprocating motions;

(d) a lifting mechanism for raising and lowering said ring rails; and (e) a suspension assembly connecting said ring rails on opposing sides of said machine and for connecting to said lifter mechanism for raising and lowering said ring rails, said suspension assembly comprising:

(i) opposing bearing brackets attached to said opposing ring rails having bearings which contact said opposing guide posts at each ring rail; and (ii) pivotally parallel linkage means pivotally interconnecting said opposing bearing brackets for producing generally opposite reaction forces between said bearings and said guide posts to reduce the wear on said guide posts.

9. The apparatus of claim 8, wherein said parallel linkage means of said suspension assembly comprises:

(a) a tension rod connected between upper portions of said opposing bearing brackets which is under tension when said ring rails are loaded; and (b) a compression rod connected between lower portions of said opposing bearing brackets which is under compression when said ring rails are loaded.

10. The apparatus of claim 9 including means for adjusting the length of said tension rods and said compression rods so that said bearings may be adjusted in their contact with said guide posts.

11. The apparatus of claim 8 comprising:

(a) slip joint means for connecting one end each of said tension and compression rods to said bearing brackets in a manner that said one end may move pivotally and in translational motion relative to said bearing bracket.

12. The apparatus of claim 11, wherein the ends of said tension and compression rods remote from said one end carried by said slip joint means is affixed to the other of said opposing bearing brackets by pivot means which allows said other ends to pivot but affixes said ends against translational motion.

13. The apparatus of claim 8, wherein said bearings comprises upper and lower bearings carried by each of said bearing brackets, said bearings being carried on the same side of said guide posts.

14. In a textile yarn twister having an elongated frame with a row of spindles extending along opposing sides of said frame and vertically reciprocating ring rails extending along said rows of spindles carrying a plurality of rings associated with spindles for guiding yarn, a plurality of opposing guide posts disposed adjacent said ring rails for guiding said ring rails as they reciprocate vertically, a ring rail lifter mechanism adapted to raise and lower said ring rails in unison, wherein the improvement comprises a suspension assembly for raising and lowering said ring rails which include:

(a) bracket means carried by opposing ring rails having bearings for contacting opposing guide posts; and (b) parallel linkage means interconnecting said bracket means for producing generally opposite but equal reaction forces to loads placed on said opposing ring rails effectively reducing bearing loads on said guide posts when said ring rail loads are equal and applying the differences between said loads when said ring rail loads are different so that uneven loading and wear of said guide posts is reduced.

15. The apparatus of claim 14, wherein said suspension assembly comprises:

(a) a front bearing bracket for connection to one of said ring rails and a rear bearing bracket for connection to the other of said ring rails;

(b) said front and rear bearing brackets including upper and lower bearings for contacting said guide posts;

(c) said parallel linkage means including vertically spaced rods each having their remote ends pivotally connected between said front and rear bearing brackets; and (d) loads placed on said ring rails causing a reaction in said pivotal rods of said linkage means forcing said upper bearing of said front bracket and said lower bearing of said rear bracket towards said guide post while a load on said opposing ring rail causes said lower bearing of said front bearing bracket and said upper bearing on said rear bearing bracket towards said guide post.

16. The apparatus of claim 14, wherein said suspension assembly comprises:

(a) a front bearing bracket connected to one of said ring rails and a rear bearing bracket connected against the other of said ring rails; and (b) said parallel linkage means comprising a tension rod connected between an upper portion of said front and rear bearing brackets and a compression rod connected in compression between lower portions of said front and rear bearing brackets.

17. The apparatus of claim 16, wherein said suspension assembly includes;

(a) a pivotal slip joint carried by one of said bearing brackets for receiving a first end of said tension rod in a manner that said first end pivots and moves in translational motion;

(b) a pivot for connecting a second end of said tension rod to the other of said bracket bearings for pivotal movement fixed against translation;

(c) a second pivotal slip joint carried by one of said bearing brackets for receiving a first end of said compression rod in a manner that said first end pivots and moves translational motion; and (d) a pivot for connecting a second end of said compression rod to the other said bearing brackets for pivotal movement fixed against translational motions.

18. The apparatus of claim 17, wherein said slip joint which connects said first end of said tension rod comprises:

(a) abutment means for limiting the translational motion of said tension rod in a first direction; and (b) second abutment means carried by said first end of said compression rod for limiting translational motion of said compression rod in a second direction opposite to said first direction.

* * * * *